US009680211B2

(12) United States Patent
Kletsov et al.

(10) Patent No.: US 9,680,211 B2
(45) Date of Patent: Jun. 13, 2017

(54) ULTRA-WIDEBAND ANTENNA

(71) Applicant: SAMSUNG ELECTRONICS CO., LTD., Suwon-si (KR)

(72) Inventors: Andrey Vladimirovich Kletsov, Moscow (RU); Artem Rudolfovich Vilenskiy, Moscow (RU)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 29 days.

(21) Appl. No.: 14/590,623

(22) Filed: Jan. 6, 2015

(65) Prior Publication Data

US 2015/0295324 A1 Oct. 15, 2015

(30) Foreign Application Priority Data

Apr. 15, 2014 (RU) ..... 2014115187
Aug. 27, 2014 (KR) ..... 10-2014-0112145

(51) Int. Cl.
*H01Q 13/10* (2006.01)
*H01Q 1/38* (2006.01)

(52) U.S. Cl.
CPC ..... *H01Q 1/38* (2013.01)

(58) Field of Classification Search
CPC ..... H01Q 9/40; H01Q 9/27; H01Q 1/36
USPC ..... 343/700 MS, 769, 833, 895
See application file for complete search history.

(56) References Cited

U.S. PATENT DOCUMENTS 5,124,713 A 6/1992 Mayes et al.
6,407,721 B1 6/2002 Mehen et al.
6,466,177 B1 10/2002 Kunysz
6,853,351 B1 * 2/2005 Mohuchy ..... H01Q 9/27 343/700 MS
7,106,255 B2 9/2006 Du Toit
7,750,861 B2 * 7/2010 Delgado ..... H01Q 9/27 343/701
8,552,922 B2 10/2013 Igwe
8,564,500 B2 10/2013 Tanabe et al.
2004/0119642 A1 6/2004 Truthan
(Continued)

FOREIGN PATENT DOCUMENTS

JP 2002-94322 A 3/2002
JP 10-0562952 B1 3/2006
(Continued)

*Primary Examiner* — Dameon E Levi
*Assistant Examiner* — David Lotter
(74) *Attorney, Agent, or Firm* — Sughrue Mion, PLLC

(57) ABSTRACT

The present invention relates to ultra-wideband (UWB) directional circular-field-polarization antennae. The technical result consists in development of a UWB antenna in which a unidirectional radiation is naturally generated within a wide or ultra-wide frequency band and generally does not require the use of an absorber on a back side of a radiating element. The UWB antenna comprises: a dielectric substrate; at least one feed line formed on the dielectric substrate; a spiral radiating element formed on the substrate and coupled to said at least one feed line; at least one additional dielectric substrate arranged in parallel with and above said dielectric substrate, wherein a flat printed cavity of an axially-symmetric shape is formed on said at least one additional dielectric substrate, said cavity being arranged coaxially with the spiral radiating element.

14 Claims, 2 Drawing Sheets

(56) References Cited

U.S. PATENT DOCUMENTS

| | | | | |
|---|---|---|---|---|
| 2004/0164908 | A1* | 8/2004 | Pietig | H01Q 1/243 343/700 MS |
| 2007/0126641 | A1 | 6/2007 | Saily | |
| 2012/0229363 | A1* | 9/2012 | Webb | H01Q 1/007 343/895 |

FOREIGN PATENT DOCUMENTS

| | | | |
|---|---|---|---|
| JP | 2008-109220 | A | 5/2008 |
| JP | 2008-294791 | A | 12/2008 |
| JP | 2012-205144 | A | 10/2012 |
| KR | 10-2011-0031614 | A | 3/2011 |
| TW | I253204 | B | 4/2006 |

* cited by examiner

ULTRA-WIDEBAND ANTENNA

CROSS-REFERENCE TO RELATED APPLICATION

This application claims priority from Russian Patent Application No. 2014115187, filed on Apr. 15, 2014 in the Russian Patent Office, and Korean Patent Application No. 10-2014-0112145, filed on Aug. 27, 2014 in the Korean Intellectual Property Office, the disclosures of which are incorporated herein by reference in their entireties.

BACKGROUND

1. Field

The present invention relates to ultra-wideband (UWB) directional circular-field-polarization antennae and can be used to receive/transmit UWB ultra-short pulses and narrow-band carrier-frequency-tunable signals.

2. Description of the Prior Art

UWB circular-field-polarization antennae are actively used in fixed communication systems if data transmission to an end user is necessary with the proviso that a user's antenna polarization is unknown. Examples of such devices can be communication devices arranged in the vicinity of a human body (BAN standard). A flat spiral antenna is a known type of UWB radiators that use the principles of self-complementarity and electrodynamic self-similarity. Slot and microstrip spiral antennae are widely used in various systems. To make a radiation of such antennae unidirectional, reflecting surfaces or absorbers arranged on one side of a spiral are used. Said techniques essentially deteriorate the antenna broadbandness and efficiency.

Strip "patch" (metal plate) cavities (multilevel strip cavities) coupled with a feed line by means of a slot aperture and used as UWB signal radiators are widely covered in the literature. Using non-resonant apertures for a beam pattern, similar systems can provide the property of unidirectionality. In such a case, however, the difficulty emerges with the requirement of radiating a circular-polarized signal, said difficulty resulting from the spiral antenna structure.

Known from US 2012229363 is a directional wideband antenna designed to enhance cell coverage within a building and comprising a spiral antenna with feed-point configured to transfer energy to/from the antenna, an energy absorbent backing to reduce a back lobe, a cavity behind the log-spiral slot antenna and in front of the energy absorbent backing, and a cable connector coupled to a shaped microstrip line coupled to the feed-point and designed to transform the input impedance to the antenna impedance. The disadvantage of the present solution is high loss caused by the absorbent, while said loss could be reduced at use of stacked strip cavities that however complicate the antenna structure.

Known from U.S. Pat. No. 7,106,255 B2 is an antenna that comprises a first patch including at least one slot-like part thereon, a second patch including at least one strip-like part thereon, wherein said slot-like parts at least partially cross each other thereby forming a coupling region. The disadvantage of such the antenna is that its gain factor is insufficient to implement communications for long distances. In addition, the present antenna has no circular polarization, and this absence may cause deterioration of the communication stability at variation of a mutual position of the receiving and transmitting devices; said absence does not allow use of the present antenna for communications between stationary and portable mobile devices.

The antenna disclosed in US 20040119642 A1 is designed for transmitting and receiving circularly polarized signals and uses strip elements of a special shape. Assigned to the disadvantages of said antenna should be that its gain coefficient is insufficient for said applications.

SUMMARY

Use of the present invention allows development of UWB slot spiral circular-field-polarization antennae that are as good in the directivity as known unidirectional spiral antennae; using strip cavities coupled with a spiral, however, the antennae of the invention generate a unidirectional radiation naturally within a wide or ultra-wide frequency band (depending upon the complexity and a number of cavities). Thus, the technical result provided by the invention is that the use of an absorber on the back side of the spiral becomes unnecessary, and does not result in essential radiation power loss when the absorber is mounted, wherein a gain factor of the circular-polarization antenna is significantly increased.

Said technical result is accomplished by that an ultra-wideband antenna for ultra-wideband communication with portable mobile devices according to the invention comprises: a dielectric substrate; at least one feed line formed on the dielectric substrate; a spiral radiating element formed on the substrate and coupled to said at least one feed line; at least one additional dielectric substrate arranged in parallel with and above said dielectric substrate, wherein a flat printed cavity of an axially-symmetric shape is formed on said at least one additional dielectric substrate, said cavity being arranged coaxially with the spiral radiating element.

Preferably, said feed line is embodied as a feeding microstrip line (MSL) or as a coplanar line.

In a preferential manner, a screen of a conductive material is formed on a dielectric substrate side facing said at least one additional dielectric substrate, said spiral radiating element is formed as a spiral slot in said screen, wherein said spiral slot is coupled with said at least one MSL via a respective additional ultra-wideband MSL-to-slot transformer.

The spiral slot can be embodied in a shape selected from the group including an Archimedes spiral and a log-periodic spiral.

Metal printed cavities preferably can be embodied in the same shape with the same dimensions. In doing so, the shape of metal printed cavities can be selected from the group including a circle, an ellipse, an octagon, a hexagon.

Preferably, the metal printed cavities have axially-symmetrical cut-outs.

In an exemplary embodiment, an absorbing material can be placed on said dielectric substrate side opposite to additional dielectric substrates.

In exemplary embodiments, said at least one additional dielectric substrate can be separated from said dielectric substrate by an air gap or a gap filled with a dielectric having a low dielectric permeability, for example foam plastics, or by a gap having a high dielectric permeability.

In accordance with the invention, said technical result above is also accomplished by an antenna system formed as an antenna array comprising at least two ultra-wideband antennae according to anyone of the embodiments above.

DETAILED DESCRIPTION

Figure 1:
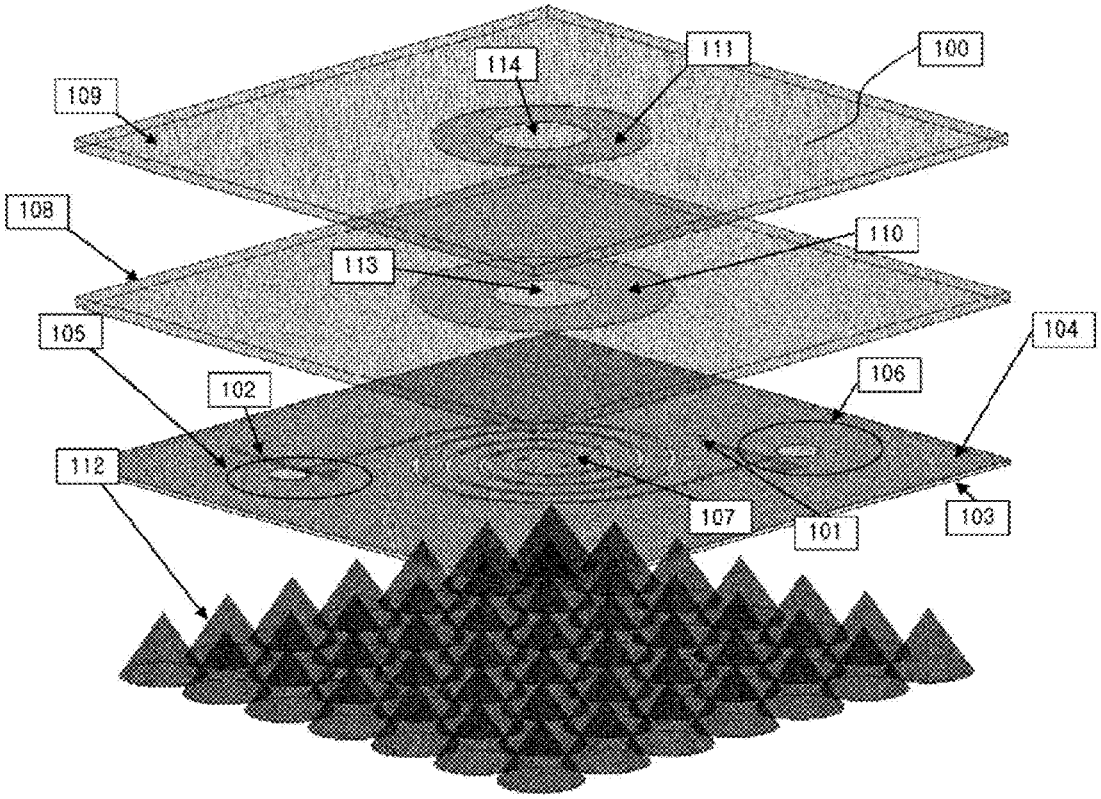
FIG. 1 is a general view of an embodiment of an antenna formed in two-wire configuration.
Figure 2:
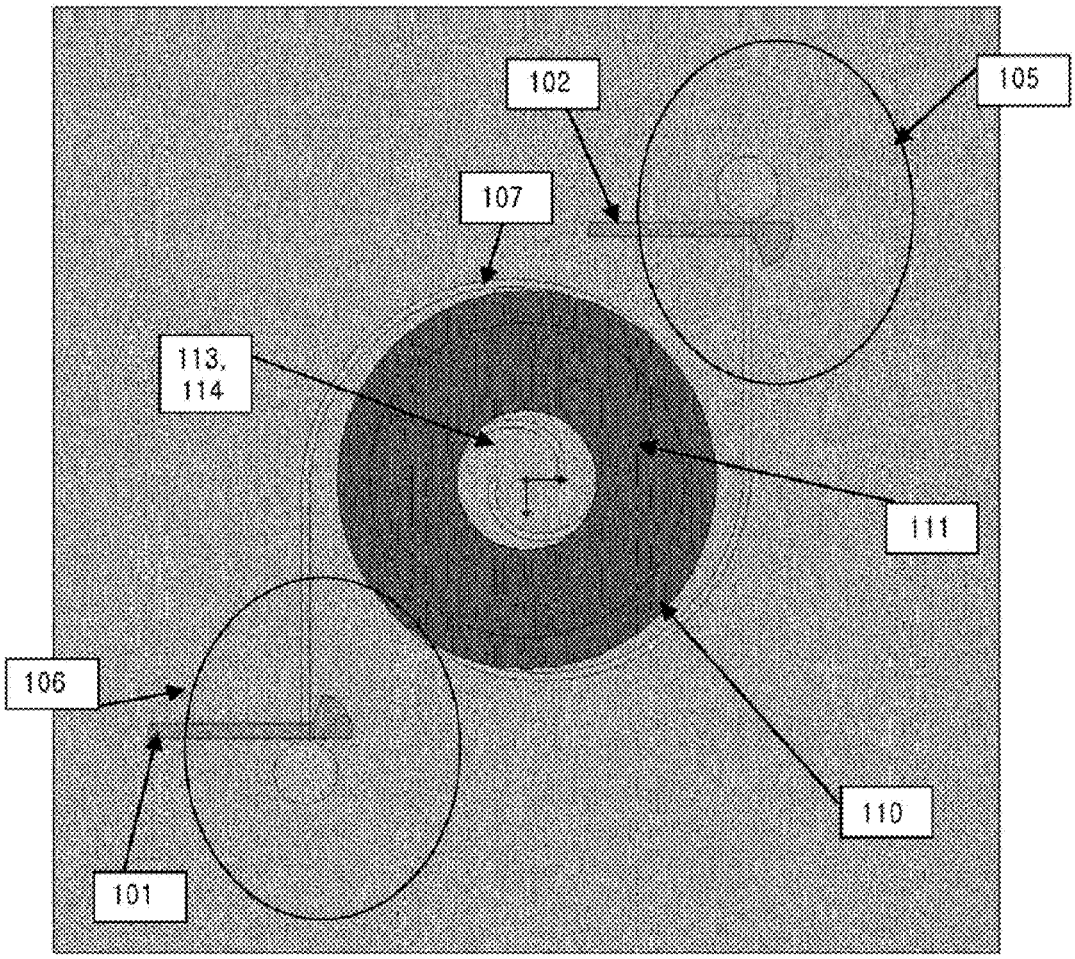
FIG. 2 is a top view presenting details of planar structures of antenna structural elements according to FIG. 1.

FIGS. 1, 2 show a general view of the antenna of the invention in case of using a two-thread spiral and two coupled cavities. In the drawings, reference numbers designate the following: 101, 102—feeding micro strip lines (MSLs); 103—MLS substrate; 104—MLS screen; 105, 106—UWB MLS-slot transformers; 107—two-wire spiral slot; 108, 109—substrates of coupled cavities; 110, 111—coupled printed cavities; 112—absorber, 113, 114—openings in cavities 110 and 111, respectively.

Referring to the Figures, a spiral antenna 100 corresponding to the invention has a structure as follows: feeding microstrip lines (MSLs) 101, 102 are formed on a dielectric substrate 103 and designed to excite a slot line 107 via a respective UWB transformer 105, 106, said line being formed in a MLS screen 104. As shown in FIG. 1, a respective straight-line length of the slot smoothly transits into a spiral one. The spiral may have anyone of known shapes: Archimedes, logarithmic, etc. Two flat supporting dielectric substrates 108, 109 are arranged one above the other on an upper side of the screen 104 of the MSLs 101, 102 where the slot spiral 107 is formed. The flat printed cavities 110, 111 are formed on the substrates 108, 109. A number and a shape of the cavities 110, 111 can be varied, however, the essential requirement is their identity in two orthogonal axes (a circle, a square, a cross, etc.) to provide the quality of circular polarization. In order to eliminate residual back radiation of the slot spiral 107, a layer of an absorber 112 is arranged on the other side from the spiral antenna 100. In order to simplify the design, the slot spiral can be formed as both a single-thread and two-thread one. In case if the two-thread spiral is used, an in-phase UWB splitter of the feed line should be used.

The UWB antenna 100 (FIG. 1) embodied according to the invention can be used within fixed devices to transmit/receive UWB radio signals from miniature mobile devices operating in communication networks in the immediate vicinity of a body. To improve the performance in said networks, the polarization of a transmitted signal should be circular.

The UWB antenna 100 can be produced of any material suitable for multilayered printed circuit boards, such as FR-4, Rogers and others. The UWB antenna 100 is fed via the MSLs 101 and 102 formed on a lower surface of the dielectric substrate 103. A metal screen 104 is on the upper side of the substrate 103. The UWB MSL-to-slot transformers 105 and 106 and the two-thread spiral slot 107 are formed (as cut-outs) directly in the MLS screen 104.

Microwave signals arriving at MSLs 101 and 102 come to the MSL-to-slot transformers 105, 106. The transformers 105 and 106 transfer a signal to the spiral slot 107. The spiral slot 107 emits said signals into environment. In the initial state, the slot 107 emits to upper and lower hemispheres (half-spaces). When the cavities 110 and 111 are arranged above the slot 107, a microwave signal will be redistributed to the upper hemisphere.

In an embodiment of the present invention, the MSLs 101 and 102 can be fed from a single point using an additional microwave power splitter.

In an embodiment of the present invention, the MSL can be substituted for other type of a conductor, for example a coplanar line. In this case, the transformers 105 and 106 also should be relied upon a respective coplanar input.

In an embodiment of the present invention, the spiral slot 7 can be substituted for a spiral microstrip line. In this case, the MSLs 101 and 102 can be coupled directly to the spiral line, and the need to use the transformers 105 and 106 falls down. In this case, the screen 104 is not necessary as well.

In an embodiment of the present invention, the spiral slot 107 can be shaped as the Archimedes or log-periodic spiral or any other type of spiral.

Substrates 108 and 109 of the coupled cavities are above the MLS substrate 103 at a certain distance therefrom and in parallel therewith, upper surfaces of said substrates 108 and 109 having the metal coupled printed cavities 110 and 111 thereon. The metal coupled printed cavities 110 and 111 have cut-offs 113 and 114, respectively. Said cut-offs allow additional improvement in the property of circular polarization.

In an embodiment of the present invention, absorbing material 112 is placed on the lower side of the MSL substrate 103.

In an embodiment of the present invention, a number of parallel substrates 108 and 109 with the metal coupled printed cavities 110 and 111 not less than two.

In an embodiment of the present invention, the substrates 108 and 109 and the MLS substrate 103 have air gaps therebetween.

In an embodiment of the present invention, the substrates 108 and 109 and the MLS substrate 103 have gaps therebetween, said gaps being filled with a dielectric with a low dielectric permeability, for example foam plastics.

In an embodiment of the present invention, the substrates 108 and 109 and the MLS substrate 103 have a dielectric with a high dielectric permeability therebetween. This leads to reduction in a total thickness of the antenna and narrowing of frequency bandwidth as compared to the previous embodiment.

In an embodiment of the present invention, the cavities 110 and 111 are shaped with practically identical dimensions throughout their cross-sections, for example, a circle, an ellipse, an octagon, a hexagon, etc. The variant of the shape being the best from circular polarization perspectives of the transmitted signal is a circle whereas square strip cavities would result in deterioration of the circular polarization of the signal.

In an embodiment of the present invention, the cavities 110 and 111 have cut-offs inside of them, said cut-offs being shaped as a circle, an ellipse, a hexagon, an octagon, etc.

The antenna 100 has a beam pattern oriented mainly upwardly (corresponds to the view in FIG. 1). Such a property is accomplished due to use of the coupled printed cavities 110, 111 as well as the absorber 112 on the lower side. This makes it possible to use the antenna in applications where a position of a mobile device is always in front of the antenna 100. Further, in order to give a special shape to the beam pattern (for example, wide in the E-plane and narrow in the H-plane), it is possible to configure the antenna 100 into an array.

In addition, the two-thread spiral slot 107 is used in the antenna 100 as a signal radiator. Owing to this, the radio communication stability is provided irrespectively of a position of an antenna on a mobile device relative to the antenna 100.

The best embodiment of the antenna 100 of the invention comprises:

- a substrate formed of a dielectric material;
- a MSL designed to feed the antenna and formed on a lower side of the dielectric substrate;

a metal screen formed on an upper side of the dielectric substrate;

a UWB MSL-to-slot transformer embodied as cut-offs in said screen and as a conical expansion at an end of the MSL;

a two-thread Archimedes spiral slot formed in said screen;

a set of dielectric supporting substrates arranged at a certain distance above said substrate in parallel therewith, said set of dielectric supporting substrates having an air gap between all layers;

a set coupled cavities arranged on surfaces of said supporting substrates and having a circular shape to provide the best characteristic of circular polarization;

a set of cut-offs formed in each of said coupled cavities and having a circular shape.

The antenna of the invention can be used for wireless communications between devices arranged in the vicinity of a body, and with devices being out of the body. The antenna of the invention has the wide beam pattern in the horizontal plane and the narrow beam pattern in the vertical plane such that its beam pattern is fixed and has the high gain. Due to the high gain of the antenna, it can be used for communications at a sufficiently long distance and in accordance with IEEE 802.15.6 for wireless networks operating in the vicinity of a surface of the body. The device comprising the antenna of the invention can be stationary (for example, a TV set).

What is claimed is:

1. An ultra-wideband antenna for ultra-wideband communication with portable mobile devices, the ultra-wideband antenna comprising:

a dielectric substrate;

at least one feed line formed on the dielectric substrate;

a spiral radiating element formed on the substrate and coupled to the at least one feed line;

at least one additional dielectric substrate arranged in parallel with and above the dielectric substrate, wherein a flat printed cavity in a symmetric shape around an axis of the flat printed cavity is formed on an upper surface of each of the at least one additional dielectric substrate, and the flat printed cavity is arranged coaxially with the spiral radiating element.

2. The ultra-wideband antenna according to claim 1, wherein the feed line is embodied as a feeding micro strip line (MSL).

3. The ultra-wideband antenna according to claim 1, wherein the feed line is embodied as a coplanar line.

4. The ultra-wideband antenna according to claim 2, wherein a conductive material screen is formed on a dielectric substrate side facing the at least one additional dielectric substrate, the spiral radiating element is formed as a spiral slot in the screen, and wherein the spiral slot is coupled with the at least one MSL via a respective additional ultra-wideband MSL-to-slot transformer.

5. The ultra-wideband antenna according to claim 4, wherein the spiral slot is embodied in a shape selected from the group including an Archimedes spiral and a log-periodic spiral.

6. The ultra-wideband antenna according to claim 1, wherein the at least one additional dielectric substrate includes a first additional dielectric substrate having a first metal printed cavity and a second additional dielectric substrate having a second metal printed cavity, and the first and second metal printed cavities are embodied in a same shape and dimension to each other.

7. The ultra-wideband antenna according to claim 6, wherein the shape of the first and second metal printed cavities is selected from the group including a circle, an ellipse, an octagon, a hexagon.

8. The ultra-wideband antenna according to claim 6, wherein the first metal printed cavity has a cut-out in a symmetric shape around an axis of the first metal printed cavity and the second metal printed cavity has a cut-out in a symmetric shape around an axis of the second metal printed cavity.

9. The ultra-wideband antenna according to claim 1, wherein an absorbing material is placed on the dielectric substrate side opposite to additional dielectric substrates.

10. The ultra-wideband antenna according to claim 1, wherein the at least one additional dielectric substrate is separated from the dielectric substrate by an air gap.

11. The ultra-wideband antenna according to claim 1, wherein the at least one additional dielectric substrate is separated from the dielectric substrate by a gap filled with a dielectric having a dielectric permeability.

12. The ultra-wideband antenna according to claim 1, wherein the at least one additional dielectric substrate is separated from the dielectric substrate by a gap having a dielectric permeability.

13. An antenna system formed as an antenna array comprising at least two ultra-wideband antennae according to claim 1.

14. The ultra-wideband antenna according to claim 11, wherein the dielectric includes foam plastics.

* * * * *